US006431943B1

(12) United States Patent
Rehkemper et al.

(10) Patent No.: US 6,431,943 B1
(45) Date of Patent: Aug. 13, 2002

(54) FINGER-OPERATED TOY BICYCLE

(75) Inventors: Steven Rehkemper; Jeffrey Rehkemper; Peter Greenley, all of Chicago; Keith Johnson, Des Plaines, all of IL (US)

(73) Assignee: Rehco, LLC

( * ) Notice: Subject to any disclaimer, the term of this patent is extended or adjusted under 35 U.S.C. 154(b) by 0 days.

(21) Appl. No.: 09/731,548

(22) Filed: Dec. 8, 2000

(51) Int. Cl.[7] ..... A63H 17/16
(52) U.S. Cl. ..... 446/440
(58) Field of Search ..... 74/551.9; 280/286, 280/288.4; 446/440, 451, 465, 466; D3/211

(56) References Cited

U.S. PATENT DOCUMENTS 595,966 A * 12/1897 Norton
615,793 A * 12/1898 Bowman
1,042,136 A * 10/1912 Mershon et al.
2,568,374 A 9/1951 Thomas
2,591,523 A * 4/1952 Dick
2,976,056 A * 3/1961 Henry
3,368,811 A * 2/1968 Finney
3,964,765 A * 6/1976 Zenser
4,438,661 A * 3/1984 Cullen ..... 74/551.9
4,582,178 A 4/1986 Huneault
D413,433 S * 9/1999 Robertson ..... D3/211
6,146,237 A 11/2000 Rehkepmer et al.

* cited by examiner

*Primary Examiner*—John A. Ricci

(57) ABSTRACT

A toy bicycle that is a scale model including frame, seat, handlebar, front and rear wheel assemblies and front and rear suspension systems comparable to a full-sized bicycle. The bicycle may also include various rear and front brakes such that the user may apply a downward force to either the front or rear end of the bicycle and stop the turning of the respective wheel. There are also included various finger-operated attachments that permit the user to more readily and easily control the toy bicycle with one or more fingers.

24 Claims, 14 Drawing Sheets

FINGER-OPERATED TOY BICYCLE

FIELD OF THE INVENTION

This invention relates to toy bicycles, and more particularly to a finger-operated toy bicycle.

BACKGROUND OF THE INVENTION

Bicycles have long been a popular means of transportation for children and adults. Younger children although not old enough to ride a bicycle are very fascinated by bikes. Various small toy-like bicycles in the past typically do not provide younger children with a bicycle that truly resembles a real full moving bicycle. For example, expensive scale replica bicycles typically represent antique bicycles or motorcycles but are fragile and are not for younger children to play with. Also, other die-cast bicycles with figurines attached thereto may include freely rotatable wheels, however, the pedals, brakes and sprockets typically will not move.

Thus there has long been a need for a true-scale model of various bicycles. Also, the toy bike must be capable of being operated by ones fingers to allow the operator to move and control the bicycle, do wheelies and other tricks and movements one can do on a full-sized bicycle.

Some prior art references, which may be relevant to the present invention, are as follows: Applicants' prior U.S. Pat. No. 6,146,237 to Rehkemper et al., discloses a toy finger operated bicycle that includes brake means in connection with the front and rear end and oversized pedals and pegs to facilitate finger operation of the bicycle. In addition, U.S. Pat. No. 4,582,178 to Huneault discloses a seat brake system that is actuated when the bicycle seat tilts forwards and backwards and U.S. Pat. No. 2,568,374 to Thomas describes an axle and wheel assembly for a toy bicycle that permits easy removal and insertion of such assembly against the frame. The prior art however, fails to disclose, teach, motivate or suggest the invention disclosed herein.

Other die-cast toy bicycles, which provide a means to operate the bicycle with the operator's fingers, only provide limited control of the bicycles, because these other bicycles have rigid frames. When the bicycles travel over uneven terrain, or when turning, the user typically loses control over the bicycles. Therefore a need exists to provide an operator with greater control on various terrain surfaces.

SUMMARY OF THE INVENTION

In accordance with the present invention there is illustrated and disclosed a bicycle that in a preferred embodiment is essentially a toy size such as a $1/15^{th}$ scale version of a full-sized bicycle that is capable of being operated like a regular bicycle by ones fingers. It contains the basic parts of a bicycle such as front and rear tire wheels; pedals, sprockets, and a belt drive assembly for the rear wheel, seat, handle bars and frame so that one playing with the toy bike can do everything one riding a regular bicycle can do. The bicycle also includes a front and rear suspension system to increase control over the bicycle and to enhance the tricks one can perform while operating the bicycle. In addition, various attachments are provided herein to further enhance tricks and control over the bicycles.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE INVENTION

Figure 1A:
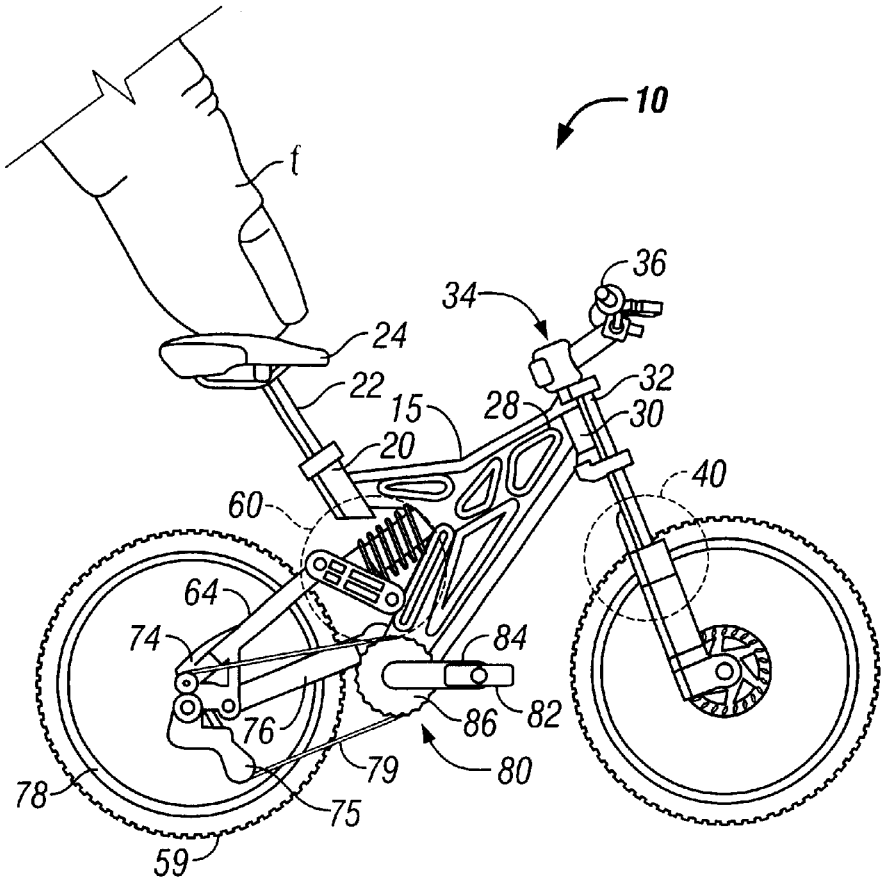
FIG. 1*a* is a plan side view of a finger-operated bicycle with front and rear suspension systems.

While the invention is susceptible to embodiments in many different forms there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

With reference to the drawings, wherein like numerals indicate like elements, there is disclosed herein a finger-operated bicycle that provides more realistic suspension features attached to the front and/or rear wheels. The present invention as illustrated in FIG. 1 is approximately a $1/15^{th}$ scale replica of a bicycle having features for accommodating the fingers of the user in order to control the bike and perform tricks and/or stunts.

As illustrated in FIG. 1*a*, a bike 10 is shown to be a scale replica of a mountain bike. The bike 10 consists of a main frame 15 that includes a tubular portion 20, which is designed to slidably and frictionally receive one end of a seat post 22. The other end of the seat post 22 securely receives a seat 24. The seat 24 permits the user to place a Finger f thereon, such as shown in FIG. 1*a*, to move the bike 10.

Figure 2:
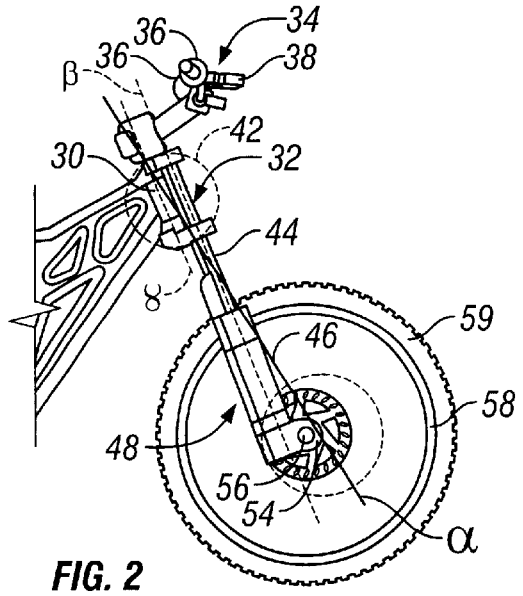
FIG. 2 is a side view of the front end of the of the bicycle shown in FIG. 1*a;*

The front end 28 of the bike 10 includes a tubular post 30 that pivotally secures a front fork 32, shown in FIG. 2. A handlebar assembly 34 attaches to the top portion of the front fork 32 and is orientated to resemble the handlebars of a real mountain bike, including hand grips 36 and brake grips 38, also shown in FIG. 3.

Figure 1B:
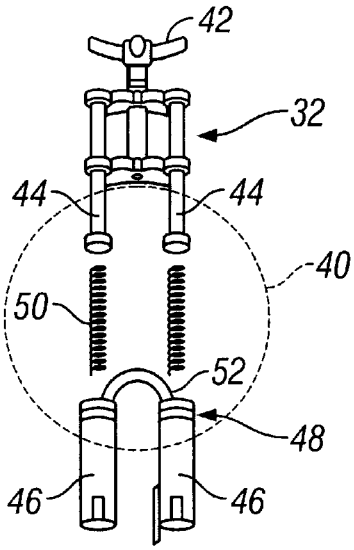
FIG. 1*b* is an exploded view of the front suspension system shown in FIG. 1*a;*

As shown in FIG. 1*b* the front fork 32 includes a front suspension system 40. The front suspension system 40 includes an upper post 42, which is offset in front of the tubular post 30, shown in FIG. 2, discussed in greater detail below. The upper post 42 includes a pair of upper shock arms 44 that slidably fit into corresponding shock sleeves 46 that define a lower post 48. Positioned between each upper shock arm 44 and its corresponding lower shock sleeve 46 is a spring 50 which normally biases the two away from each other, thereby providing the bike 10 with a real working front suspension system typically found on real mountain bikes. The lower post 48 further includes a guard 52 that attaches between the two lower shock sleeves 46.

Attached to each lower shock sleeve 46 is an extending mounting member 54, which is offset in front of the lower shock sleeves 46, shown in FIG. 2. The mounting member 54 attaches to the front wheel axle 56, which secures the wheel 58 and a tire 59 thereto.

Figure 1C:
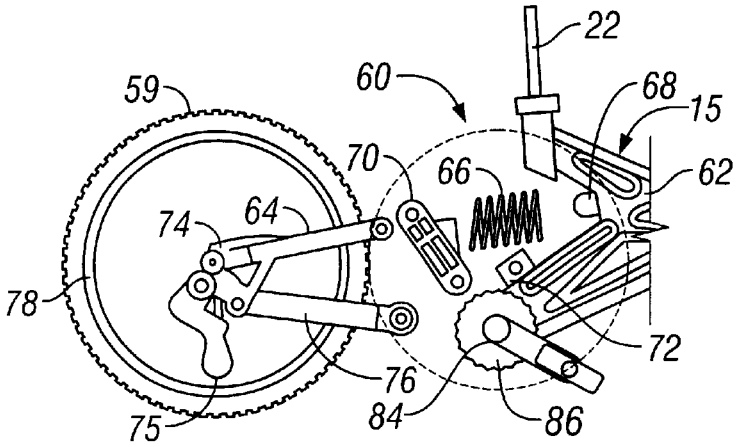
FIG. 1*c* is an exploded view of the rear suspension system shown in FIG. 1*a;*

The bike 10 also includes a rear suspension system 60 detailed in FIG. 1*c*. The rear suspension system is attached between the rear end 62 of the frame 15 and the rear fork 64. The rear suspension system 60 includes a rear spring 66 positioned between a projecting rod 68 on the rear end 62 and lever 70. The lever 70 is attached on one end to the rear fork 64 and on the other end to an attachment means 72 on the rear end 62. The rear fork 64 includes a drop out 74 that is pivotally secured to the rear end 62 by a lower support arm 76. The drop out 74 further includes a means to receive a rear crank (not shown), a rear wheel 78 and a tire 59, in a manner conventional to normal full sized mountain bikes.

A belt 79 is positioned around the rear crank and a drop link 75, which is attached to the drop out 74, and further connected around a pedal/crank/sprocket assembly 80 that is secured horizontally at the midsection of the frame 15. The pedal/crank/sprocket assembly 80 includes oversized pedals 82, which facilitate finger actuation. The pedals 82 are connected to a mid-crank 84, which extends horizontally through the midsection of the frame 15. The mid-crank 84 is drivingly connected to a sprocket 86 that drives the belt 79.

Having now described the various structural components of the toy mountain bicycle, reference is made to FIGS. 2 and 3, in which disclosure of the operation of the bike 10 will be made.

An important aspect of the invention is included in the forward offset of the upper post 42 from the tubular post 30 creating a front fork axis β that is in front of a pivotal axis γ defined in the tubular post, shown in FIG. 2. Moreover, the forward offset of the extending members 54 from the lower shock sleeves 46 creates a front wheel axle 56 that is forward from the front fork axis β. These forward offsets both independently and in combination with each other create a turning axis α that is in front of the front wheel axle 56. By having a positive turning axis (or a turning axis which is in front of the front wheel axle), when the user leans the bike 10 in one direction, the bike 10 will turn opposite of the direction of the lean, illustrated in FIG. 3, more emulating a turn on a true-scale mountain bicycle. For example, on a real bicycle, a rider when turning will lean opposite of the turn to gain balance and control of the bicycle, this will also allow the rider to make sharper and quicker turns. In accordance therewith, the present invention also emulates this, when the operator of the bike 10, leans a finger f in one direction, the bike 10 turns opposite the lean.

Figure 3:
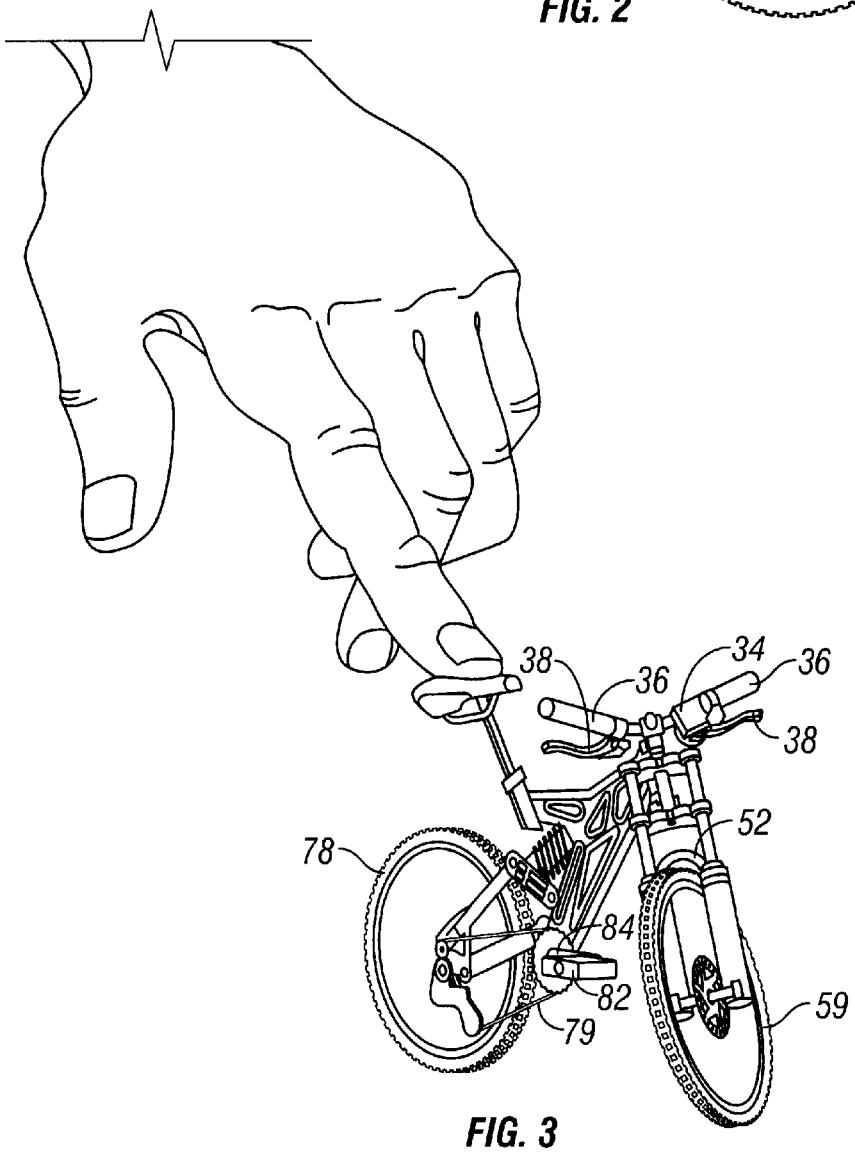
FIG. 3 is a perspective view of the bicycle of FIG. 1*a* being operated with a user's finger, while the bicycle is leaning into a turn.

When operating the bike 10, such as illustrated in FIG. 3, the user's Finger f is pushing the bike 10 in a forward direction. The rear wheel 78 is rotating which in turn will drive the rear crank and rotate the mid-crank 84 and turn the pedals 82. Similarly, when the pedals 82 are operated with the user's Fingers, the mid-crank 84 drives the belt 79, which in turn drives the rear crank and rotates the rear wheel 78. When the user operates the bike 10 over uneven terrain the front and rear suspension systems 40 and 60 will function as true-scaled suspension systems in mountain bikes.

Figure 10A:
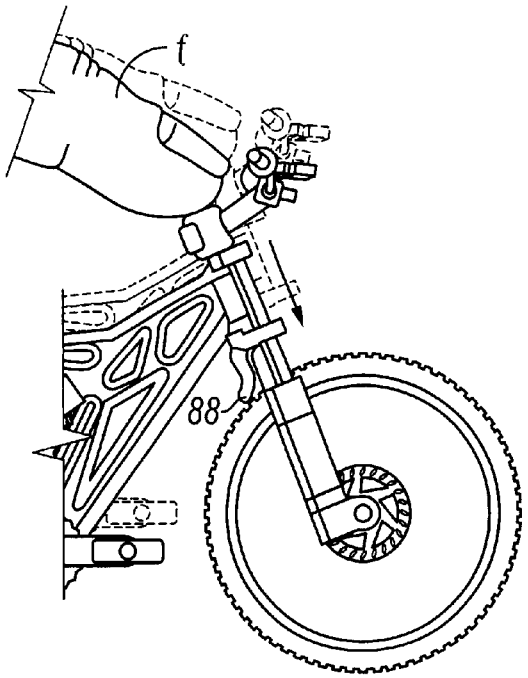
FIGS. 10*a* and 10*b* are enlarged side views of bicycle in FIG. 1*a* including a front braking means.
Figure 10B:
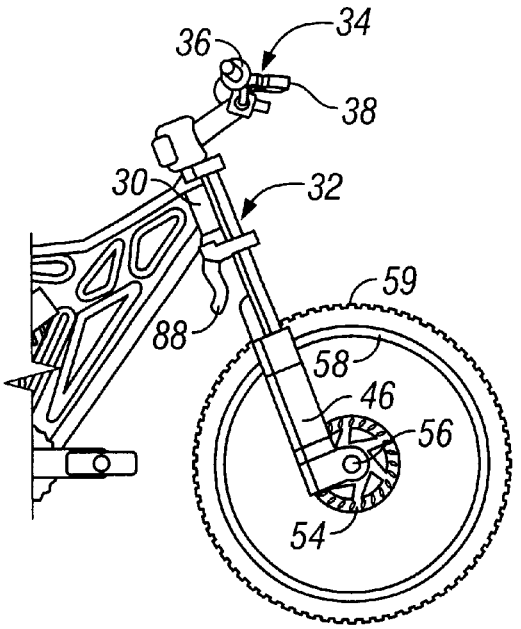

In addition, the bicycle 10 may include a front and/or rear means to brake. Shown in FIG. 10*a* and 10*b*, the bicycle 10 includes a front brake 88, which when the Finger f presses downwardly upon the front fork 32, the front brake 88 will come into contact with the front tire 59. While the front suspension system 40 acts to oppose such a force, the user can easily overcome the opposition offered by the front suspension spring 50 by applying a force greater than such opposition.

Figure 11A:
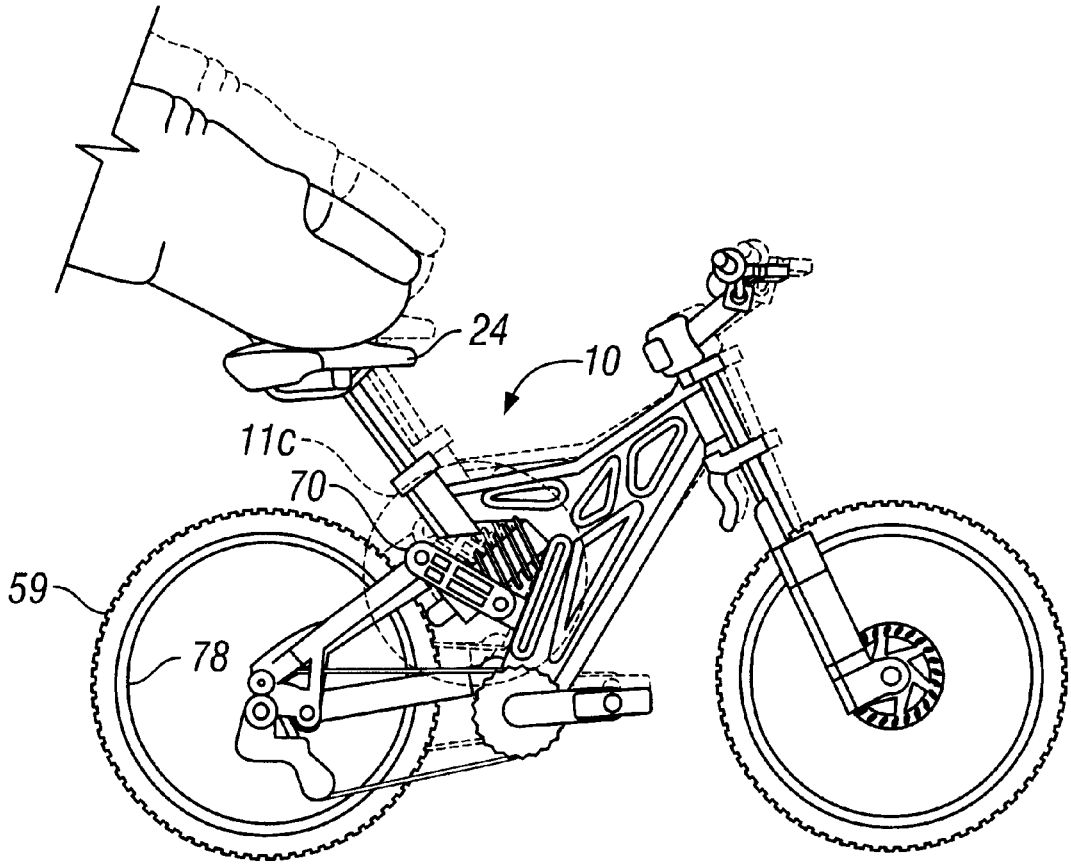
FIGS. 11*a*, 11*b*, and 11*c* are enlarged views of the bicycle in FIG. 1*a* including a rear braking means.
Figure 11B:
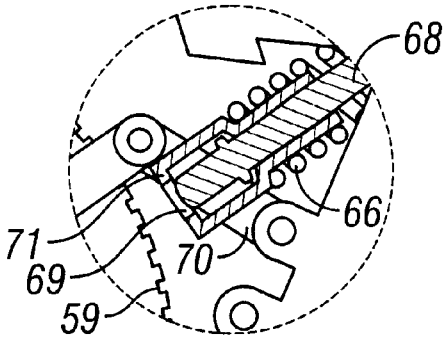
Figure 11C:
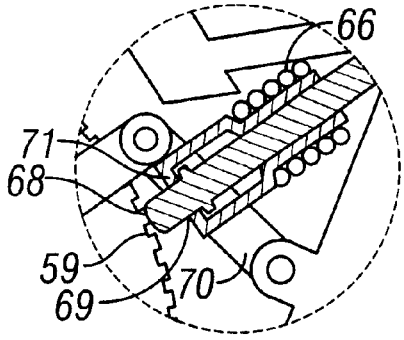

As illustrated in FIGS. 11*a*, 11*b* and 11*c* a rear braking means may also be included in the bicycle 10. The rear braking means includes the projecting rod 68, on the rear end 62, which extends through a cylinder 71 that is in communication with a bore 69 in the lever 70. When the operator pushes downwardly on the seat, the projecting rod 68 extends through the cylinder 71 and the bore 69 and comes into contact with the rear tire 59, thereby braking or stopping the bicycle 10.

Figure 4A:
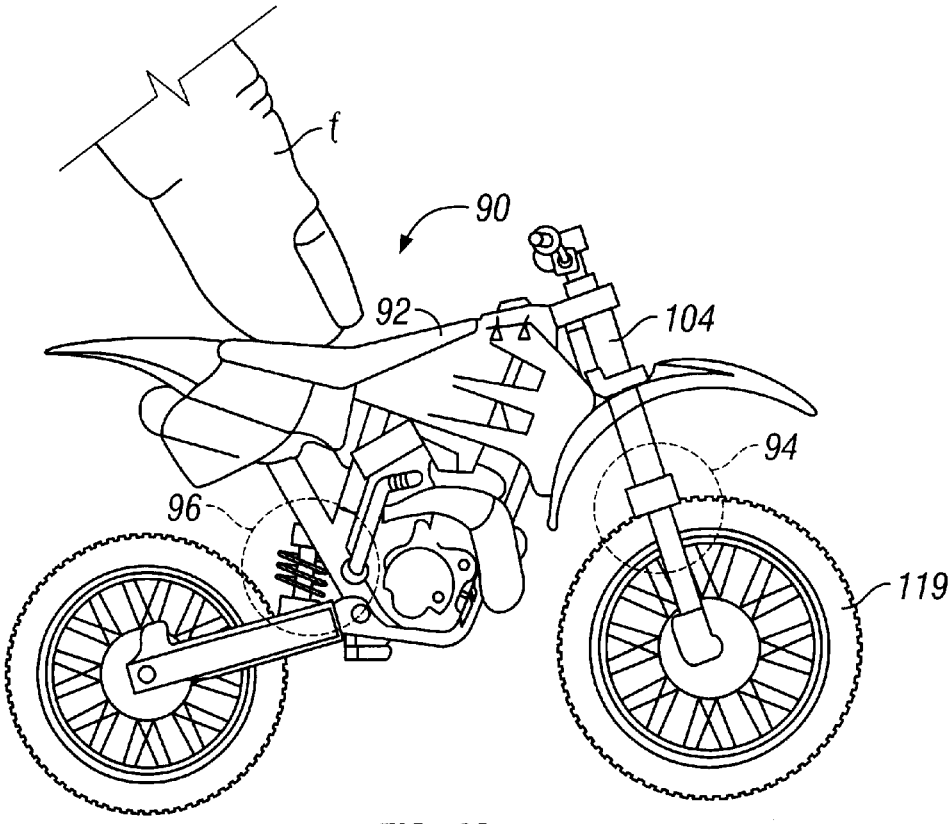
FIG. 4*a* is a plan view of another embodiment of a finger-operated vehicle with a front and rear suspension system similarly configured to a real moto-cross bicycle.

As illustrated in FIG. 4*a*, a moto-cross bike 90 is shown to be a scale replica of a real moto-cross bike having features for accommodating the fingers of the user in order to control the bike and perform tricks and/or stunts. The bike 90 consists of a frame 92 decorative of a rear moto-cross bike, which includes a front and rear suspension system 94 and 96, respectively.

Figure 4B:
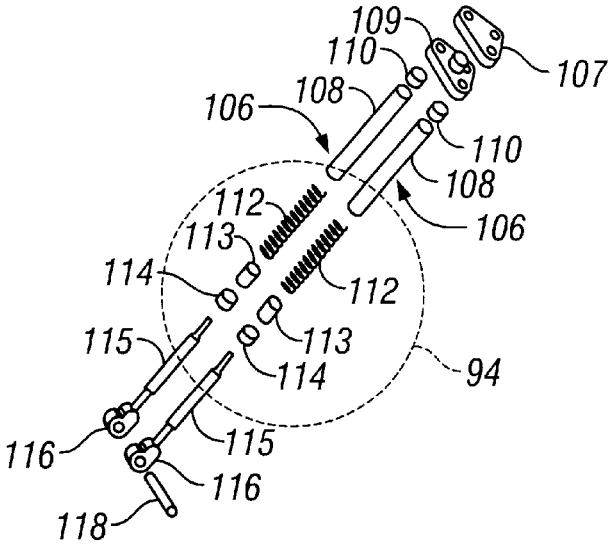
FIG. 4*b* is an exploded view of the front suspension system shown in FIG. 4*a;*
Figure 4C:
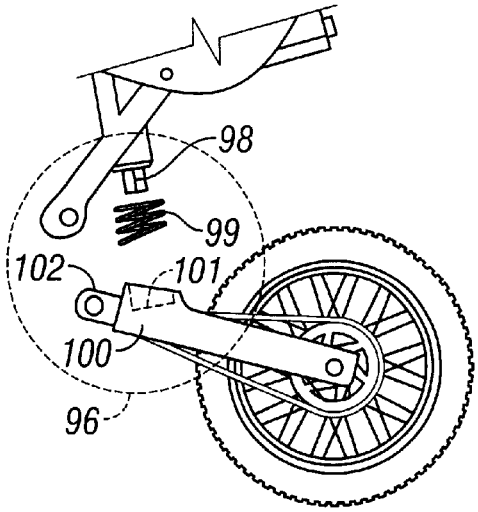
FIG. 4*c* is an exploded view of the rear suspension system shown in FIG. 4*a;*

The rear suspension system 96, shown in FIG. 4*c*, includes a rear projection 98 on the rear end of the bike 90. The rear fork 100 includes a bore 101 sized to receive the rear projection 98 and includes an attachment means 102 such that the rear fork 100 may be attached to the rear end. The rear suspension system 96 further includes a rear spring 99 placed in the bore 101 between the projection 98 and the rear fork 100, biasing the two away from each other.

The front suspension system 94, FIG. 4*b*, includes a pair of shocks 106 that attach to the front fork 104 by an upper attachment plate 107. Each shock 106 includes a shock sleeve 108 that receives at the top end an upper end member 110. Both upper end members 110 are further attached to a shock plate 109 that secures to the upper attachment plate 107. Each shock sleeve 108 further receives a shock spring 112, a lower end member 113 and a lower cap 114. Positioned through the lower cap 114 and through the lower end member 113 is a shock arm 115. When assembled, the shock spring 112 normally biases the shock arm 115 away from the shock plate 109, emulating a pair of shocks on a real moto-cross bike. The other ends of the shock arms 115 are attached to a pair of end mounts 116 that secure to the front axle 118 and front wheel 119.

Figure 12A:
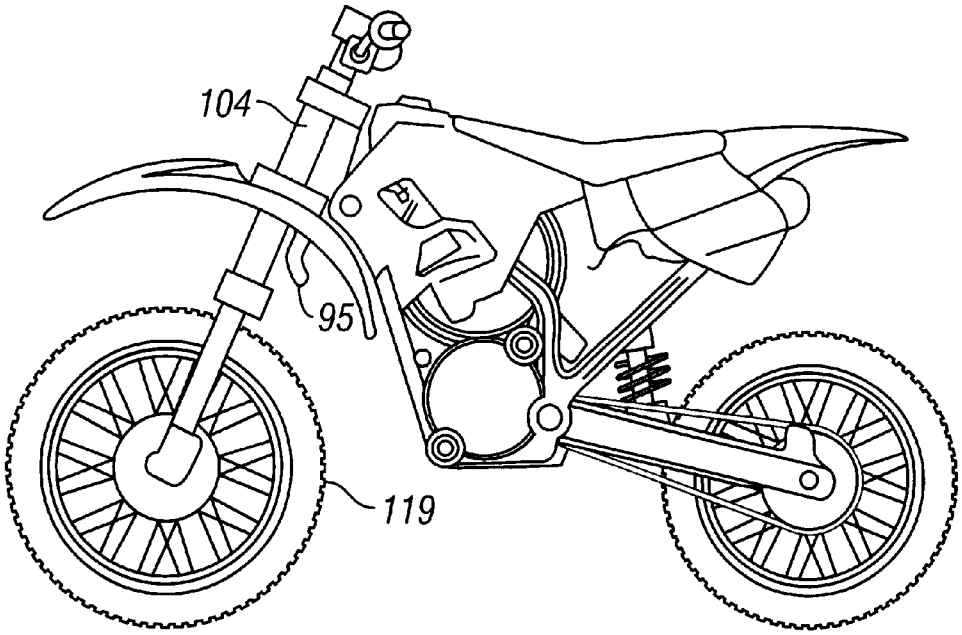
FIGS. 12*a* and 12*b* are side views of the moto-cross in FIG. 4*a* including a front braking means.
Figure 12B:
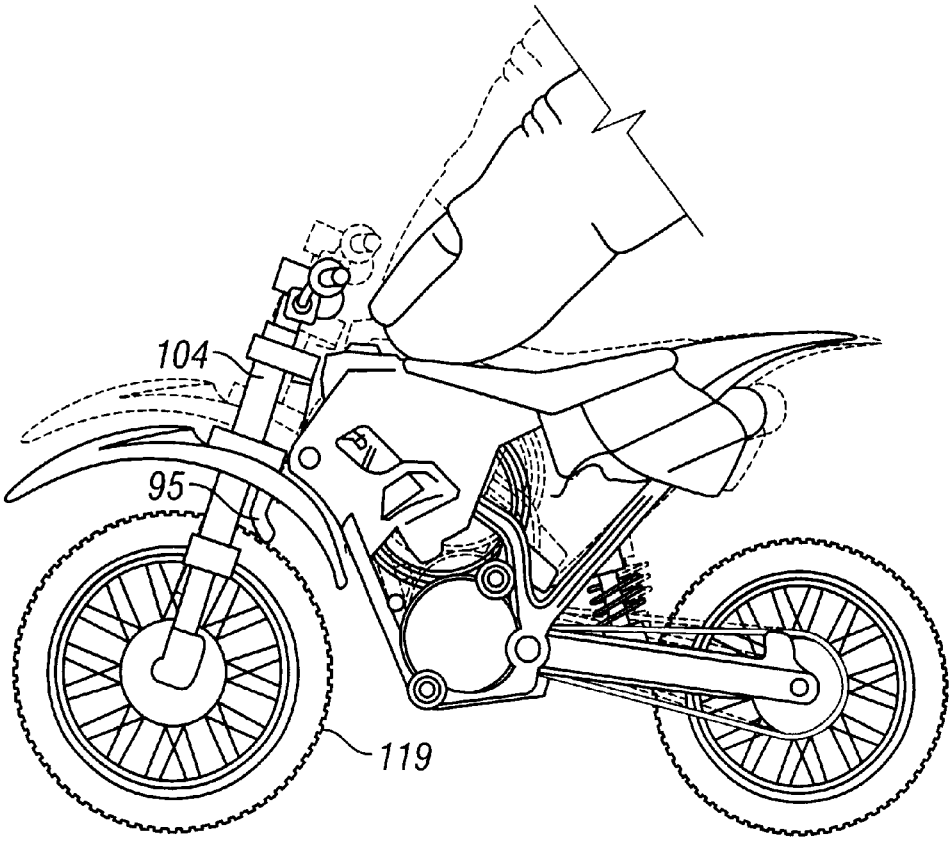
Figure 13A:
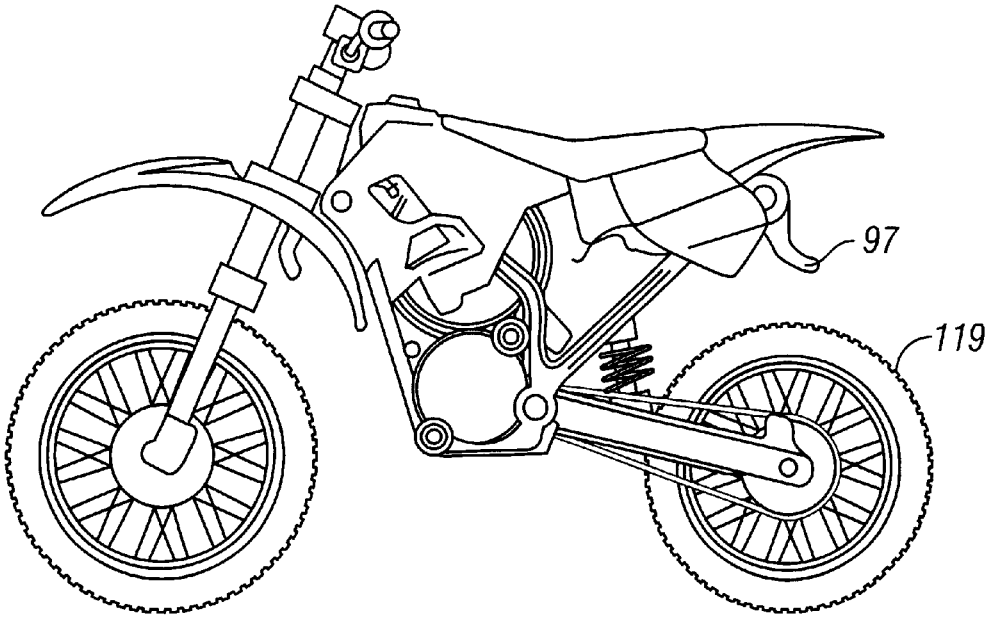
FIGS. 13*a* and 13*b* illustrate the moto-cross in FIG. 4*a* with a rear braking means.
Figure 13B:
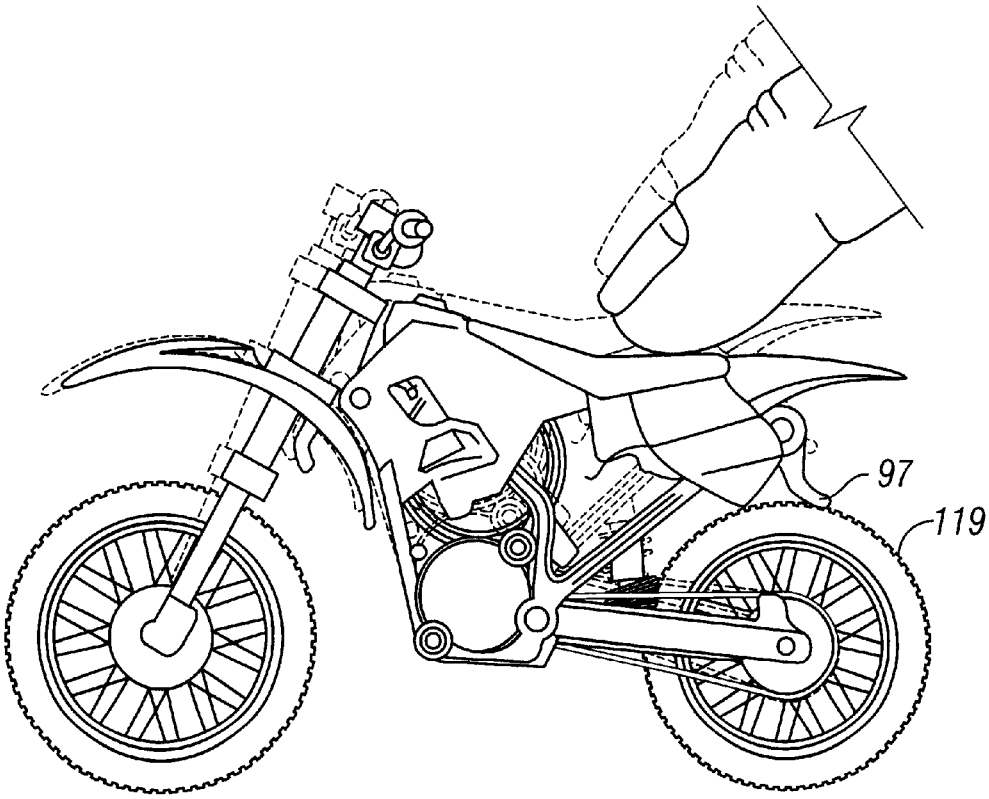

The front braking means shown in FIGS. 12*a* and 12*b* includes a projection 95 that comes into contact with the front wheel 119 when a downward pressure is applied to the front fork 104 or the front end of the frame 92. Similarly configured, the rear braking means, shown in FIGS. 13*a* and 13*b*, includes a projection 97 that will come into contact with the rear wheel 119, when a downward pressure is applied to the rear end of the frame 92. Since the front and rear suspension systems 94 and 96 respectively, are designed to bias the front and rear wheels away from the frame 92, the suspension systems will absorb some the downward pressure exerted by the user. Once the suspension systems are fully compressed, or at the end of their travel, the downward pressure exerted by the user will cause the braking means to come into contact with the wheel, slowing or stopping the wheel from rotating. As such the braking means will not engage the wheel until the suspension system is at the end of its travel.

Additional important features of the present invention include various finger attachment devices, illustrated in FIGS. 5–8, which help enhance the control of the finger-operated bikes. While the bikes provide an operator with the means to operate the bike with fingers, i.e. by the seat, handlebars, frame, peddles, etc., there still exists a need to further enhance the control over the bikes. The following finger attachment means permit the operator to control the bike either by the attachment means alone or with the above mentioned finger operator means. The following finger attachment means further increase the control over the bike by increasing the ability to control tricks, such as wheelies, jumps, spins, etc.

Figure 5A:
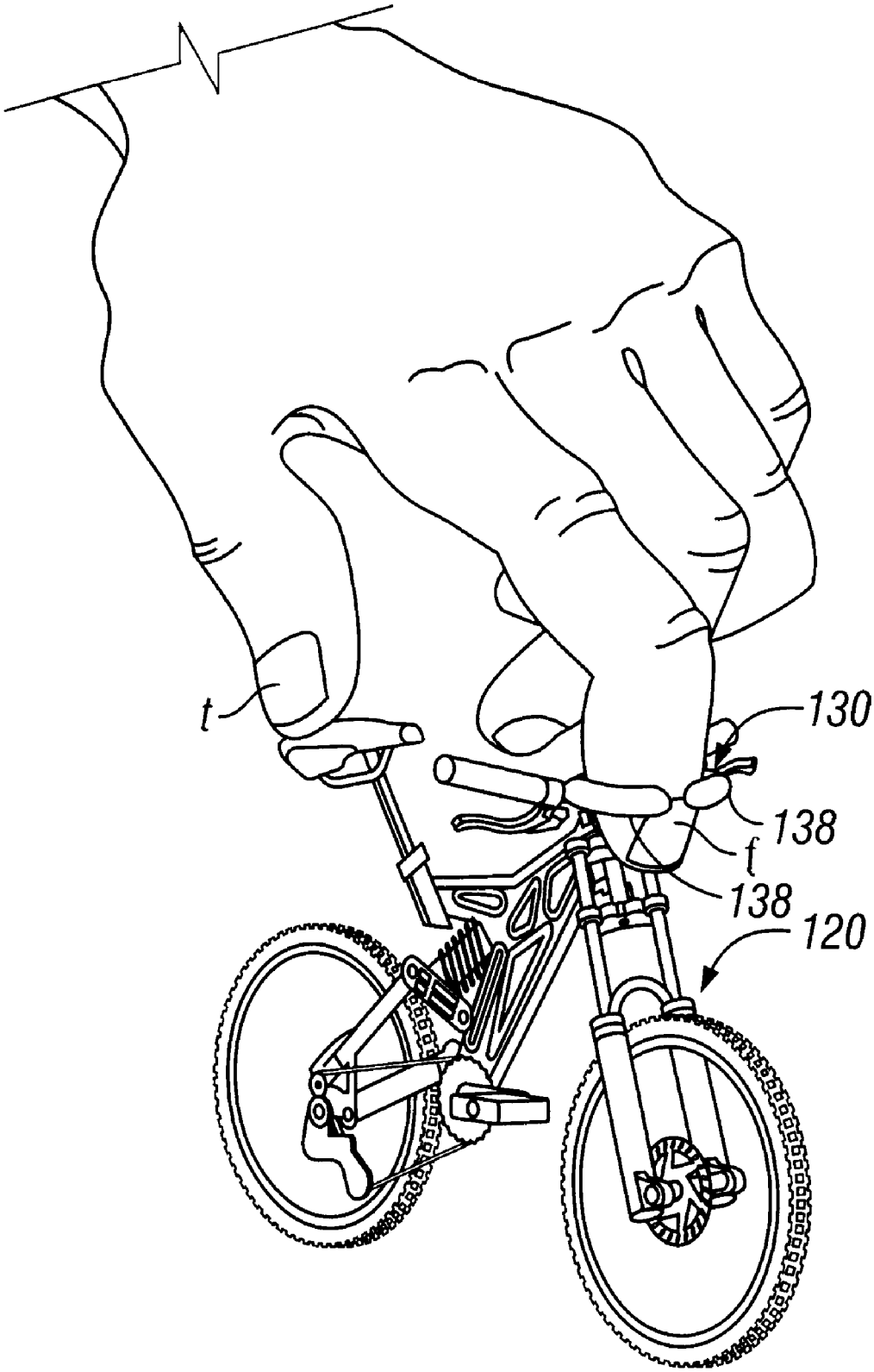
FIGS. 5*a*–5*d* illustrate various views of a single-finger control clip utilized to increase the control and enjoyment of the finger-operated toy bike.
Figure 5B:
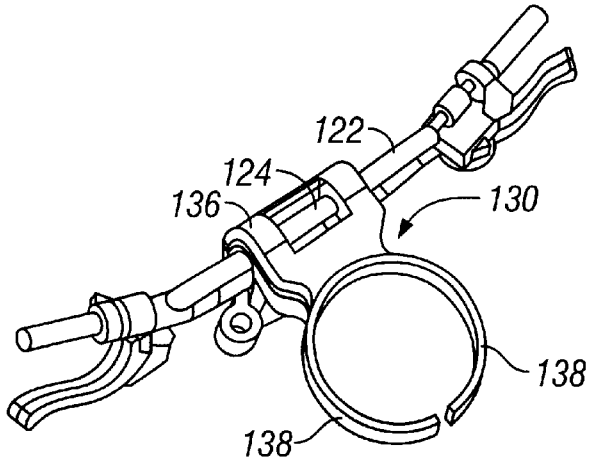
Figure 5C:
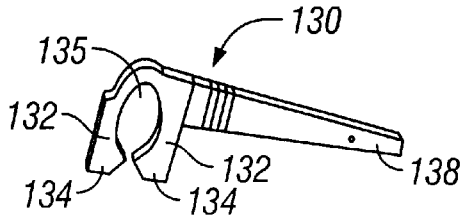
Figure 5D:
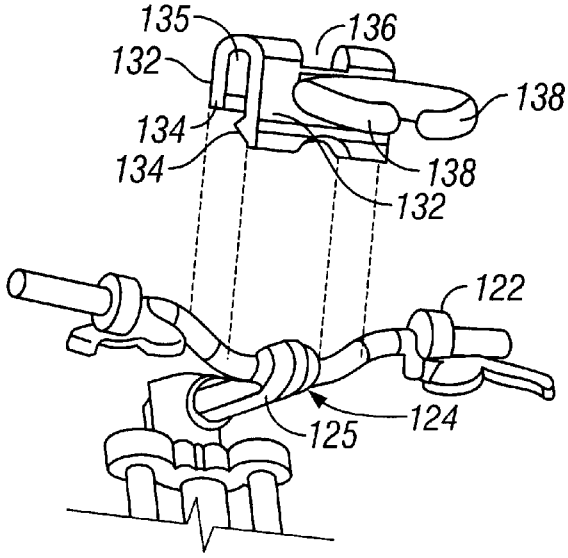

Referring now to FIGS. 5*a*–5*d*, a single-finger attachment means is shown that increases the control and enjoyment of the toy bike 120. A finger clip 130 is shown in FIG. 5*b* attached to the middle portion of the handlebar assembly 122. The finger clip 130 includes a fastening means that frictionally engages the center section 124 of the handlebars 122, illustrated in FIGS. 5*c* and 5*d*. The fastening means includes two resilient members 132 that extend downwardly. A pair of lips 134 on the lower portion of the resilient members 132 further extends toward each other to define a cavity 135 that is sized to receive the handlebars 122. Moreover, the resilient members 132 include a notch 136 to accommodate the center bar 125 of the handlebars 122. When the finger clip 130 is being attached to the handlebars 122, the resilient members 132 bend outwardly until the handlebars 122 pass the pair of lips 134 such that it rests in the cavity 135 of the fastening means. The finger clip 130 includes a pair of resilient semi-circular members 138 extending outwardly from the finger clip 130. The user may insert a Finger f in between the semi-circular members 138, shown in FIG. 5*a*, which frictionally grip and hold the Finger f in place. While the user may control and operate the bicycle with only Finger f the user may also use Thumb t, or another finger, by resting upon the seat. As such, the user may now control the bike 120 with two fingers.

Figure 6A:
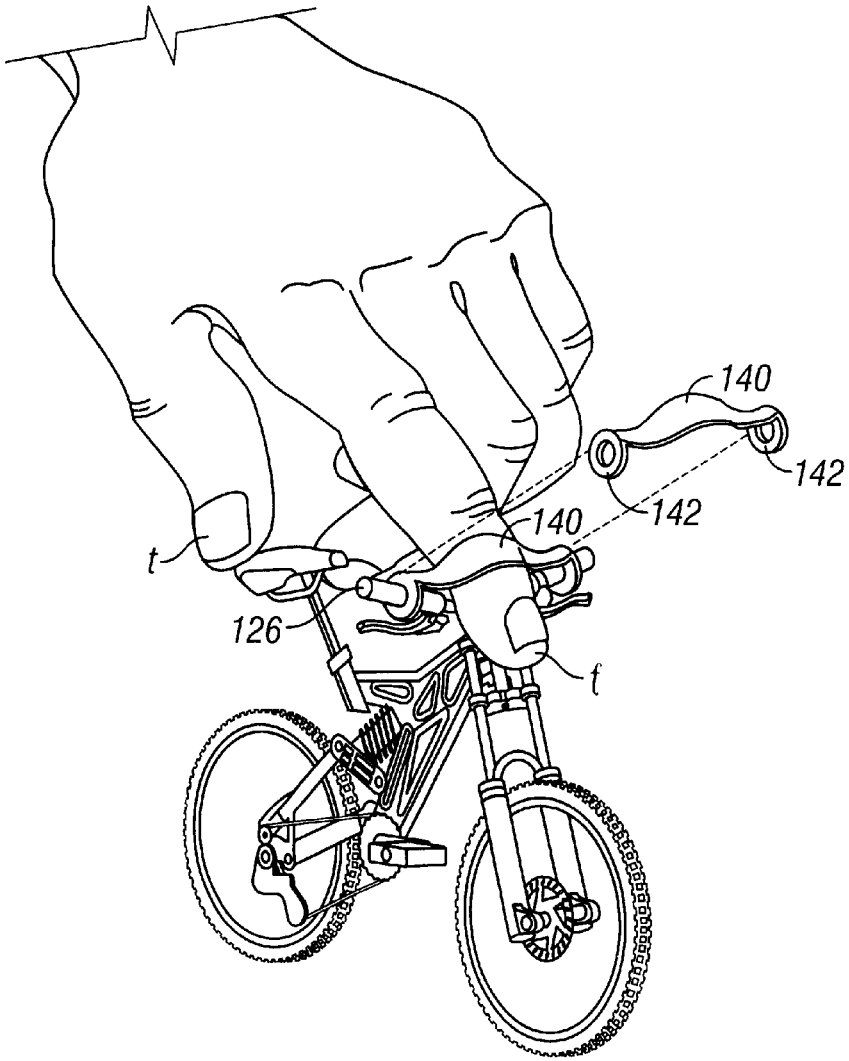
FIGS. 6*a* and 6*b* illustrate various views of a single-finger control grip utilized to increase the control of the finger-operated toy bike.
Figure 6B:
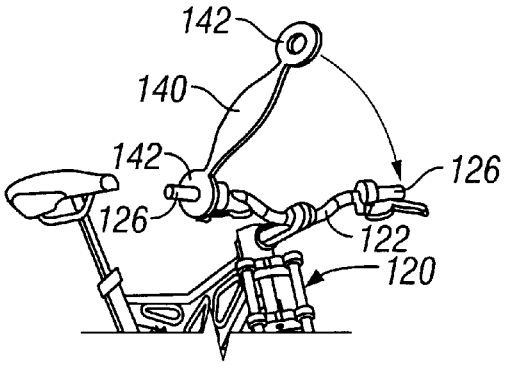
Figure 7A:
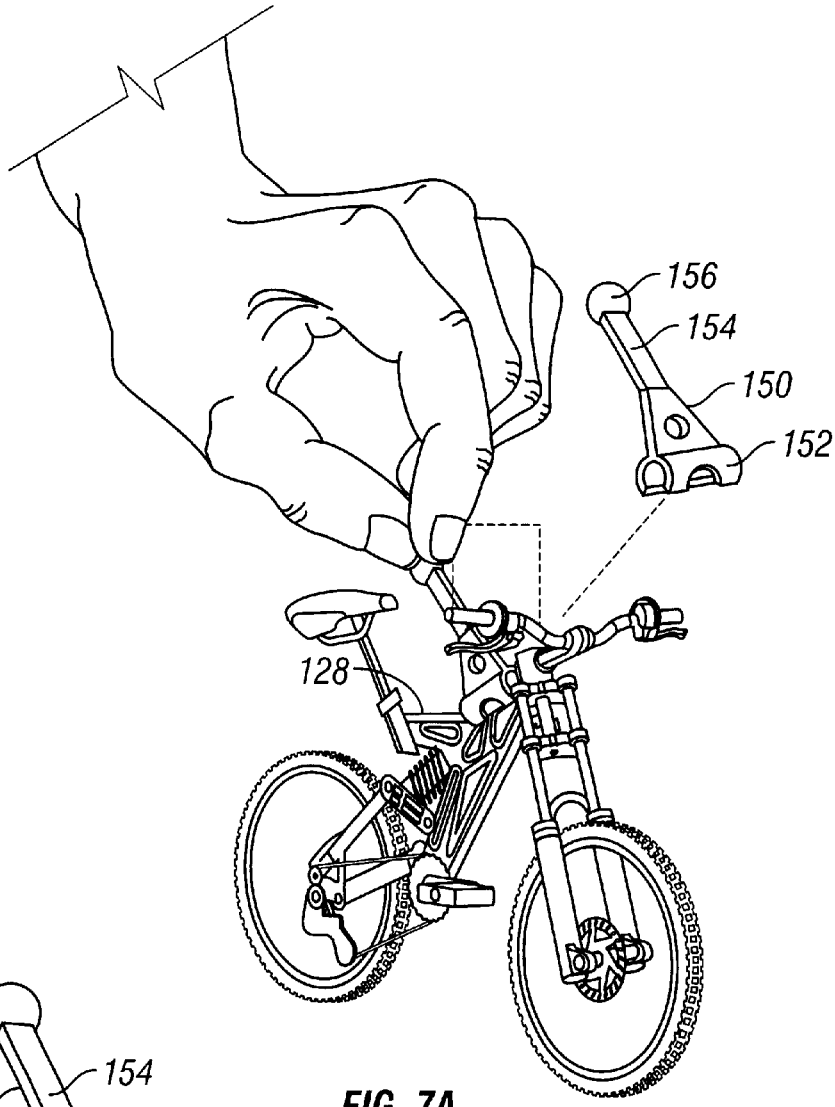
FIGS. 7*a* and 7*b* illustrate various views of a multi-finger control stick utilized to increase the control of the finger-operated toy bike.
Figure 7B:
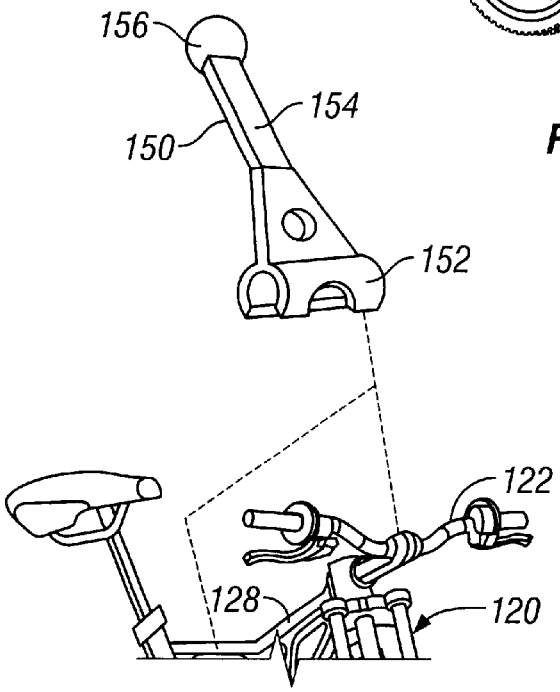

Another single-finger attachment means is illustrated in FIGS. 6*a* and 6*b*. An elastic finger grip 140 is illustrated and includes an opening 142 on both ends of the finger grip 140. The openings 142 are sized to receive the handgrips 126 of the handlebars 122. The user's Finger f is frictionally held in place between the finger grip 140 and the handlebars 122 illustrated in FIG. 6*a*.

In addition, other multi-finger attachment means are provided herein. Illustrated in FIGS. 7*a* and 7*b*, a finger control stick 150 is illustrated and includes a base 152 similarly configured to the above-defined fastening means of the finger clip 130. The base 152 frictionally engages either the frame 128 or the handlebars 122 of the bike 120. The control stick 150 also includes a control rod 154 extending upwardly from the base, which includes an oversized end 156, which permits a user to grip with two or more fingers.

Figure 8A:
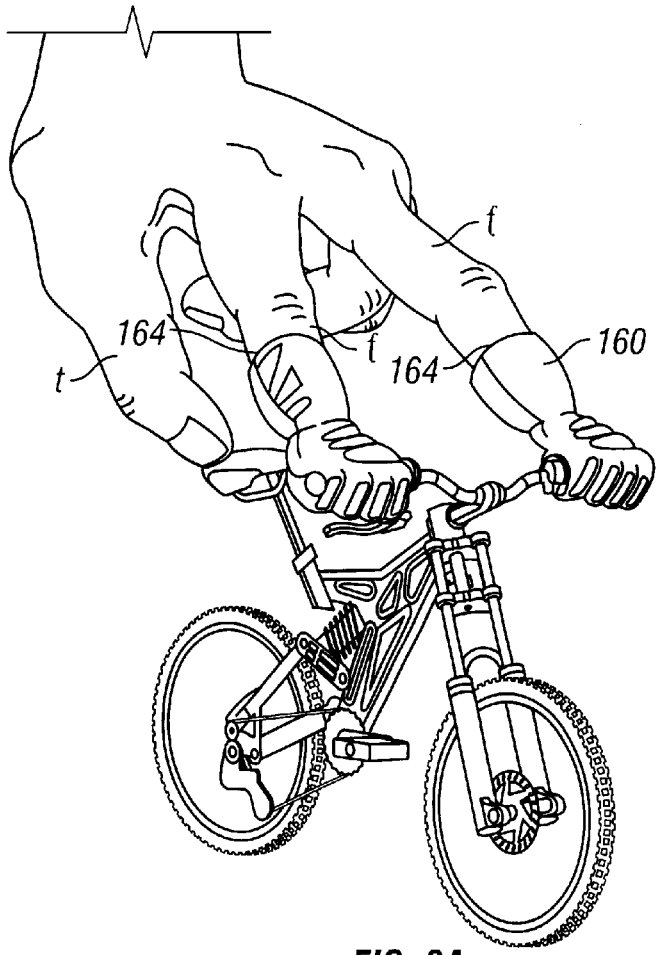
FIGS. 8*a* and 8*b* illustrate various views of a multi-finger control mechanism using finger gloves to control the handlebars of the finger-operated toy bike.
Figure 8B:
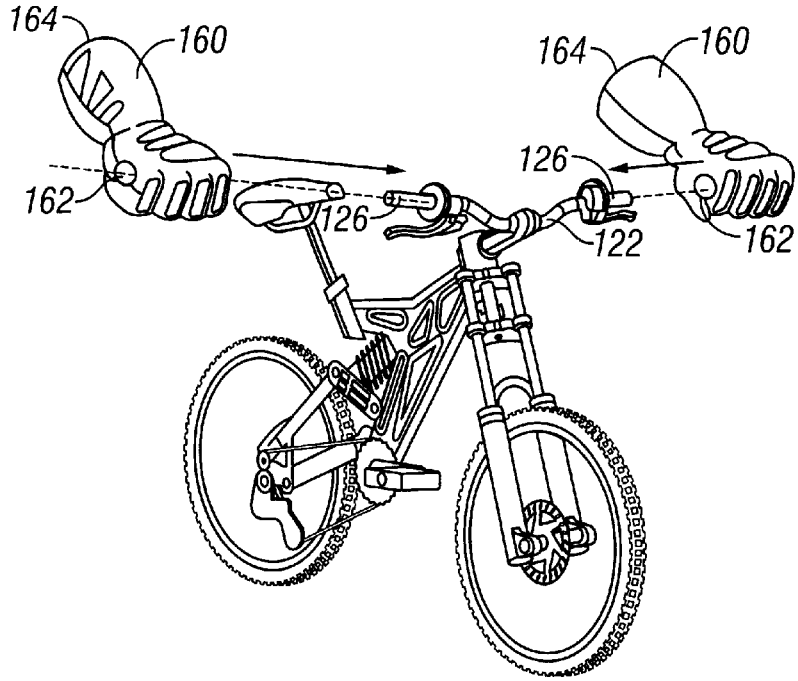

Referring now to FIGS. 8*a* and 8*b*, another multi-finger attachment means illustrated. A pair of finger gloves 160 that include an aperture 162, which is sized to receive the handgrips 126 of the handlebars 122, may be secured to the bike 120, shown in FIG. 8*b*. Each finger glove 160 also includes an opening 164 in which a user may insert a Finger f. The user by positioning a Thumb t on the seat of the bike 120, shown in FIG. 8*a*, and two Fingers f in the finger glove 160, the user may retain an increased control over the bike with three fingers.

Figure 9:
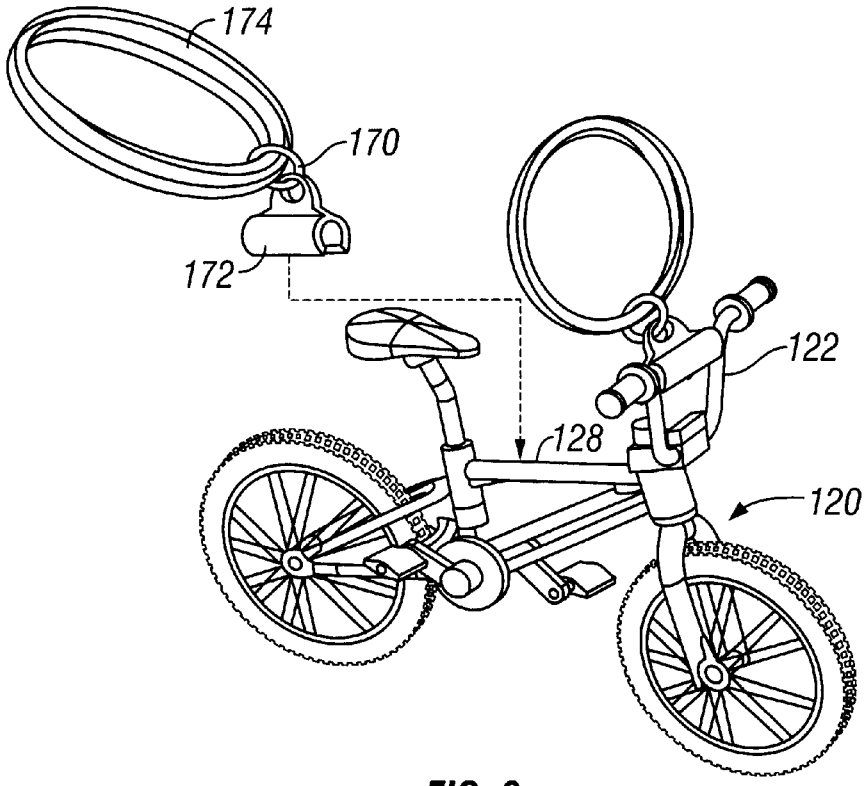
FIG. 9 is a perspective view of a key chain adapter that may be used by a user to carry the finger-operated toy bike.

In addition, FIG. 9 illustrates a novel means for the user to carry the finger bike 120 around with them. A key chain adapter 170 is shown, which includes a base 172 similarly configured to the above-mentioned fastening means for the finger clip 130. The base 172 further includes an opening for attaching a key ring 174. As similarly described above, the base 172 is defined to frictionally engage either the frame 128 or the handlebars 122 of the bike 120.

Figure 14:
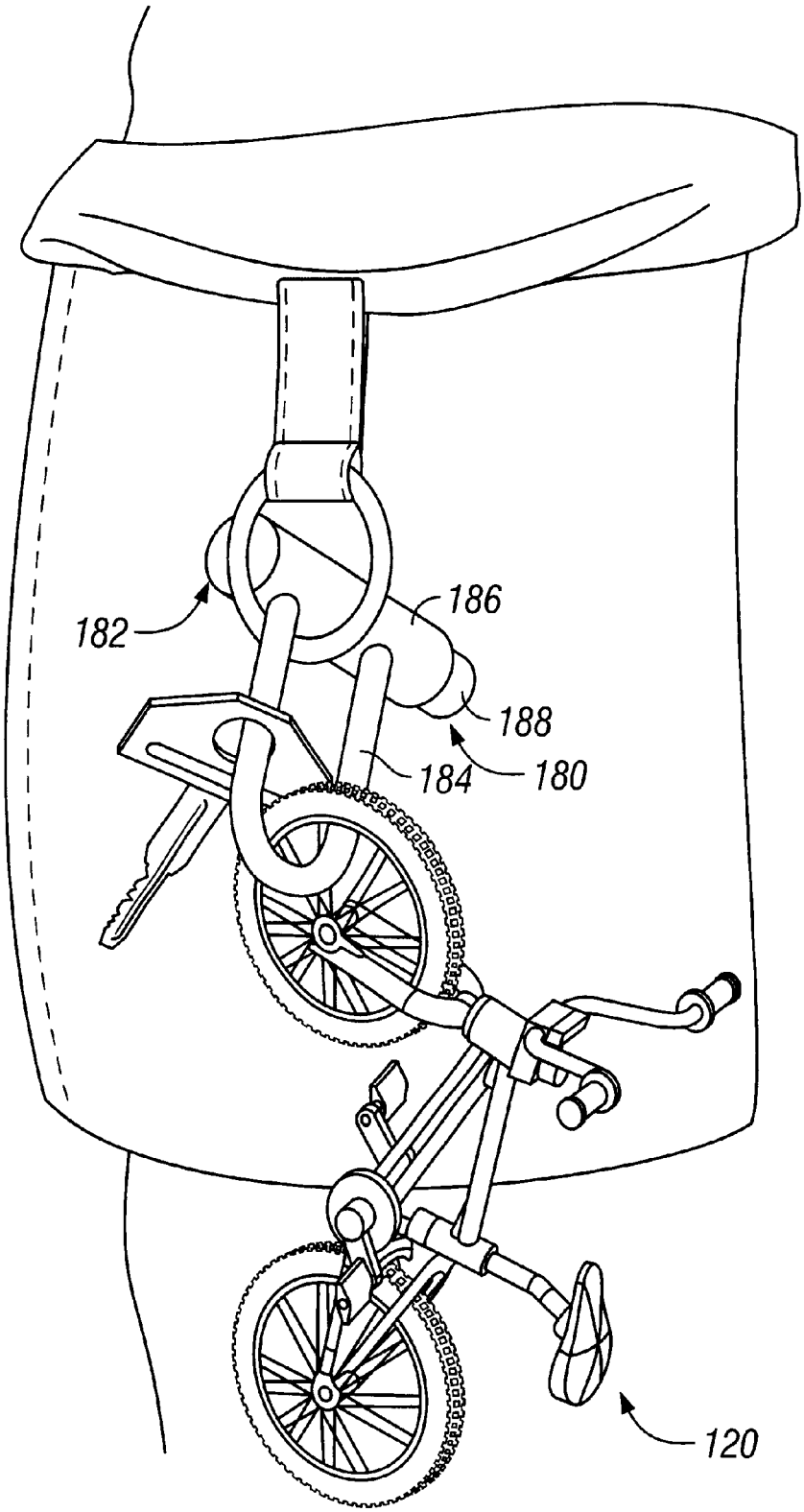
FIG. 14 is a perspective view of a key chain adapter that represents a real bicycle lock.

Alternatively, FIG. 14 illustrates another novel means for carry the finger bike 120 around with them. A key chain 180 is shown that is representative of a bicycle lock 182. The bicycle lock 182 has a hook 184 that insets into a sleeve 186. Once inserted, the hook 184 is held in place by a plunger 188 that may be release by pressing inwards. If the plunger 188 is pressed inwards, the hook 184 is released allowing the user to unlock the bike 120 and remove any keys attached thereto.

Figure 15A:
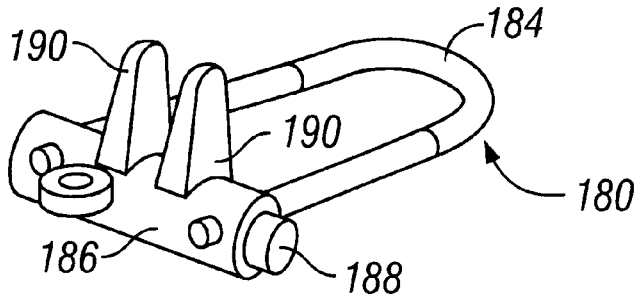
FIG. 15*a* is a perspective view of another key chain/stand adapter representative of a rear bicycle lock.
Figure 15B:
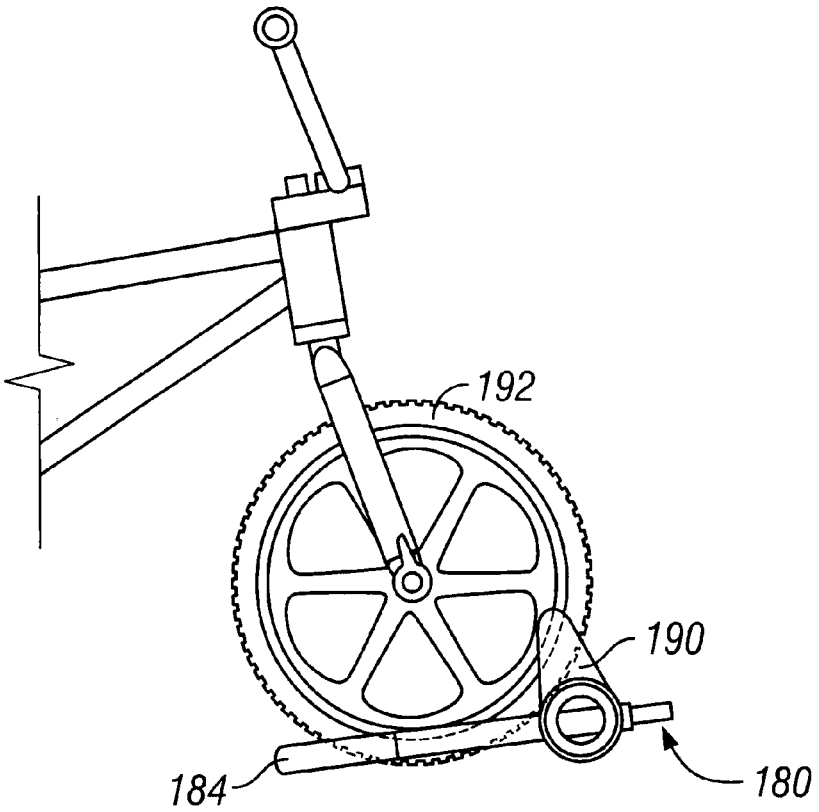
FIG. 15*b* is a side view of the key chain/stand adapter of FIG. 15*a* being used to keep a bicycle standing upright.

Referring now to FIGS. 15*a* and 15*b*, the bicycle lock/key chain 180 may also include a pair of guides 190 that extend outwardly from the sleeve 186. The guides 190 are spaced apart such that the front or rear wheel of the bicycle 120 may be positioned and held there between. As shown in FIG. 15*b*, a portion of the front wheel 192 is positioned between the guides 190 and is held in place. The rest of the front wheel 192 is resting on a flat surface inside of the hook 184, thereby providing the bike 120 with the means for keeping it standing upright.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A finger-operated toy bicycle including a frame assembly, seat assembly, handlebar assembly, front and rear wheel assemblies operatively connected to said frame assembly, and further including: a front fork assembly pivotally attached to a tubular post defined by the frame assembly and having the means to receive the handlebar assembly; a rear fork assembly attached to the frame assembly, a front suspension system secured in front of the tubular post such that a front fork axis defined through the front suspension system is offset in front of a pivotal axis defined through the tubular post causing a turning axis that is in front of the front wheel axle, and a rear suspension system, said suspension systems being secured to and biasing the front and rear wheel assemblies away from the frame assembly.

2. The finger-operated bicycle of claim 1, wherein the front suspension system includes a mounting member, the mounting member attaches to a front wheel axle defined in the front wheel assembly such that the front wheel axle is forwardly offset from a front fork axis defined through the front suspension system, causing a turning axis that is in front of the front wheel axle.

3. The finger-operated bicycle of claim 1 further including a front wheel braking means secured to the front fork and positioned to engage and stop the front wheel from turning when a downward pressure is applied to the front fork, such that the downward pressure is sufficient to completely compress the front suspension system whereby when a downward pressure is applied to the front fork, the front suspension system biasing against the downward pressure completely compresses such that the braking means engages and stops the front wheel from turning.

4. The finger-operated bicycle of claim 1, further including a rear wheel braking means secured to the rear portion of the frame assembly and positioned to engage and stop the rear wheel from turning when a downward pressure is applied to the seat, such that the downward pressure is sufficient to completely compress the rear suspension system whereby when a downward pressure is applied to the seat, the rear suspension system biasing against the downward pressure completely compresses such that the braking means engages and stops the rear wheel from turning.

5. The finger-operated bicycle of claim 1, further comprising:

a pair of finger gloves separately attached to a handle grip defined at the ends of the handlebar assembly, each finger glove further including an opening sized to grip a user's finger whereby the handlebars can be easily and readily finger-gripped to manipulate and control the bicycle.

6. The finger-operated bicycle of claim 1, further comprising:

a finger clip removably attached to the handlebar assembly, the finger clip having a pair of resilient semi-circular members which frictionally engage a user's finger whereby the handlebars can be easily and readily finger-gripped to manipulate and control the bicycle.

7. The finger-operated bicycle of claim 1, further comprising:

an elastic and resilient finger grip removably attached to the handlebar assembly, the finger grip frictionally engaging a user's finger against the handlebar assembly whereby the handlebars can be easily and readily finger-gripped to manipulate and control the bicycle.

8. The finger-operated bicycle of claim 1, further comprising:

a control stick removably attached to the bicycle, the control stick having an end which is oversized relative to the other components of the bicycle whereby the end can be easily and readily finger-gripped to manipulate and control the bicycle.

9. The finger-operated bicycle of claim 1, further comprising:

a key chain attachment means removably attached to the bicycle, the key chain attachment means having the means to attach a key ring such that the bicycle may be securely carried by the key ring.

10. The finger-operated bicycle of claim 9 wherein the key chain attachment means further includes the means to keep the bicycle upright.

11. A finger-operated toy bicycle including a frame assembly, seat assembly, handlebar assembly, front and rear wheel assemblies operatively connected to said frame assembly, and further including a finger operated attachment means removably secured to the handlebar assembly such that a user may easily and readily control and manipulate the bicycle with one finger.

12. The finger-operated bicycle of claim 11, wherein the finger operated attachment means includes a pair of finger gloves separately attached to a handle grip defined at the ends of the handlebar assembly, each finger glove further including an opening sized to grip a user's finger whereby the handlebars can be easily and readily finger-gripped to manipulate and control the bicycle.

13. The finger-operated bicycle of claim 11, wherein the finger operated attachment means includes a finger clip removably attached to the handlebar assembly, the finger clip having a pair of resilient semi-circular members which frictionally engage a user's finger whereby the handlebars can be easily and readily finger-gripped to manipulate and control the bicycle.

14. The finger-operated bicycle of claim 11, wherein the finger operated attachment means includes an elastic and resilient finger grip removably attached to the handlebar assembly, the finger grip frictionally engaging a user's finger between said finger grip and the handlebar assembly whereby the handlebars can be easily and readily finger-gripped to manipulate and control the bicycle.

15. The finger-operated bicycle of claim 11, wherein the finger operated attachment means includes a control stick having an end which is oversized relative to the other components of the bicycle whereby the end can be easily and readily finger-gripped to manipulate and control the bicycle.

16. The finger-operated bicycle of claim 11, wherein the finger operated attachment means includes a finger clip having a pair of resilient semi-circular members which frictionally engage a user's finger whereby the handlebars can be easily and readily finger-gripped to manipulate and control the bicycle.

17. The finger-operated bicycle of claim 11, wherein the finger operated attachment means includes a control stick having an end which is oversized relative to the other components of the bicycle whereby the end can be easily and readily finger-gripped to manipulate and control the bicycle.

18. The finger-operated bicycle of claim 11 further including a key chain attachment means removably attached to the bicycle, the key chain attachment means having the means to attach a key ring such that the bicycle may be securely carried by the key ring.

19. The finger-operated bicycle of claim 11 further including a key chain attachment means having a hook shaped end removably attached to a sleeve, the hook shaped end sized to fit through one of the wheels of the bicycle.

20. The finger-operated toy bicycle of claim 19 wherein the sleeve further includes two guides sufficiently spaced apart to receive one of the wheels of the bicycle such that when one of the wheels is placed between the two guides and the key chain attachment means is placed on a flat surface the bicycle is maintained in an upright configuration.

21. A finger-operated toy bicycle including a frame assembly, seat assembly, handlebar assembly, front and rear wheel assemblies operatively connected to said frame assembly, and further including a key chain attachment means removably attached to the bicycle, the key chain attachment means having the means to attach a key ring such that the bicycle may be securely carried by the key ring.

22. The finger-operated toy bicycle of claim 21 wherein the key chain attachment means has a hook that is removably attached to a sleeve, and the hook is sized to fit through one of the wheels of the bicycle.

23. The finger-operated toy bicycle of claim 22 wherein the sleeve further includes two guides sufficiently spaced apart to receive one of the wheels of the bicycle such that when one of the wheels is placed between the two guides and the key chain attachment means is placed on a flat surface the bicycle is maintained in an upright configuration.

24. The finger-operated toy bicycle of claim 20 further including a removable finger operated attachment means secured to the toy bicycle such that a user may easily and readily control and manipulate the bicycle with at least one finger.

* * * * *